US008790026B2

(12) United States Patent
Hirate

(10) Patent No.: US 8,790,026 B2
(45) Date of Patent: Jul. 29, 2014

(54) IMAGE RECORDING APPARATUS

(75) Inventor: Kensuke Hirate, Kasugai (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 494 days.

(21) Appl. No.: 12/888,096

(22) Filed: Sep. 22, 2010

(65) Prior Publication Data

US 2011/0076080 A1 Mar. 31, 2011

(30) Foreign Application Priority Data

Sep. 25, 2009 (JP) ..... 2009-220136

(51) Int. Cl.
*B41J 11/00* (2006.01)

(52) U.S. Cl.
USPC ..... 400/582; 271/9.06; 271/265.01

(58) Field of Classification Search
USPC ..... 271/13, 236, 238, 239, 240, 248, 249, 271/250, 255, 169, 221, 3.15, 256, 258.01, 271/258.05, 10.04, 265.01, 9.03, 264, 9.06, 271/265.04; 399/389; 400/582
See application file for complete search history.

(56) References Cited

U.S. PATENT DOCUMENTS

| | | | | |
|---|---|---|---|---|
| 4,469,320 | A * | 9/1984 | Wenthe, Jr. | 271/98 |
| 7,374,163 | B2 * | 5/2008 | Cook et al. | 271/145 |
| 2005/0236760 | A1 * | 10/2005 | Kang | 271/152 |
| 2007/0002089 | A1 * | 1/2007 | Kobayashi et al. | 347/16 |

FOREIGN PATENT DOCUMENTS

| | | |
|---|---|---|
| JP | 8-26527 | 1/1996 |
| JP | 8-40570 | 2/1996 |

* cited by examiner

*Primary Examiner* — Matthew G Marini

(74) *Attorney, Agent, or Firm* — Scully, Scott, Murphy & Presser, P.C.

(57) ABSTRACT

An image recording apparatus includes a body, a tray, a moving member, an actuator, a sensor, a reference position moving mechanism and a control unit. The moving member is movable to a first position, a second position, a third position and a reference position. The actuator moves the moving member to the first position, the second position and the third position. The sensor outputs an ON signal or an OFF signal based on positions of the moving member, the positions including the first position, the second position, the third position and the reference position. The reference position moving mechanism moves the moving member to the reference position. The control unit determines a detection position to be detected based on a change of the ON signal and the OFF signal of the sensor when the moving member is moved between the detection position and the reference position by the reference position moving mechanism. The control unit further determines that a recording medium held on the tray is the first recording medium when the detection position is the first position and that a recording medium held on the tray is the second recording medium when the detection position is the second position.

17 Claims, 10 Drawing Sheets

IMAGE RECORDING APPARATUS

CROSS REFERENCE TO RELATED APPLICATION

The present application claims priority from Japanese Patent Application No. 2009-220136, which was filed on Sep. 25, 2009, the disclosure of which is incorporated herein by reference in its entirety.

BACKGROUND OF THE INVENTION

1. Field of the Invention

The present invention relates to an image recording apparatus having a tray.

2. Description of the Related Art

Image recording apparatuses having a plurality of detection members. In such an image recording apparatus, a plurality of states of the recording medium are detected by the plurality of the detection members.

SUMMARY OF THE INVENTION

In such an image recording apparatus, since the plurality of detection members are used to detect the plurality of the states of the recording mediums, the manufacturing cost may be high.

A need has arisen to provide an image recording apparatus capable of detecting an equal number of the states of the recording mediums by the reduced number of detection members.

In an embodiment of the invention, an image recording apparatus includes a body, a tray, a moving member, an actuator, a sensor, a reference position moving mechanism and a control unit. The tray is capable of holding a first recording medium having a first size and a second recording medium having a second size. The moving member is movable to a first position, a second position, a third position and a reference position. The moving member positions at the first position when the first recording medium is held on the tray, positions at the second position when the second recording medium is held on the tray, and positions at the third position when neither the first recording medium nor the second recording medium is held on the tray. The actuator is configured to move the moving member to the first position when the first recording medium is held on the tray, move the moving member to the second position when the second recording medium is held on the tray and move the moving member to the third position when neither the first recording medium nor the second recording medium is held on the tray. The sensor is configured to output an ON signal or an OFF signal based on positions of the moving member. The positions include the first position, the second position, the third position and the reference position. The reference position moving mechanism is configured to move the moving member to the reference position. The control unit determines a detection position to be detected based on a change of the ON signal and the OFF signal of the sensor when the moving member is moved between the detection position and the reference position by the reference position moving mechanism. The control unit further determines that a recording medium held on the tray is the first recording medium when the detection position is detected to be the first position and that a recording medium held on the tray is the second recording medium when the detection position is detected to be the second position.

BRIEF DESCRIPTION OF THE DRAWINGS

FIGS. 5A to 5C show states of a detection mechanism when no recording sheet is stored, in which FIG. 5A shows a plan view, and FIGS. 5B and 5C show cross sections taken along line V-V in FIG. 5A.

FIGS. 6A to 6C show states of the detection mechanism when A4-sized recording sheets are stored, in which FIG. 6A shows a plan view, and FIGS. 6B and 6C show cross sections taken along line VI-VI.

FIGS. 7A to 7C show states of the detection mechanism when A3-sized recording sheets are stored, in which FIG. 7A shows a plan view, and FIGS. 7B and 7C show cross sections taken along line VII-VII.

DESCRIPTION OF THE PREFERRED EMBODIMENTS

Figure 1:
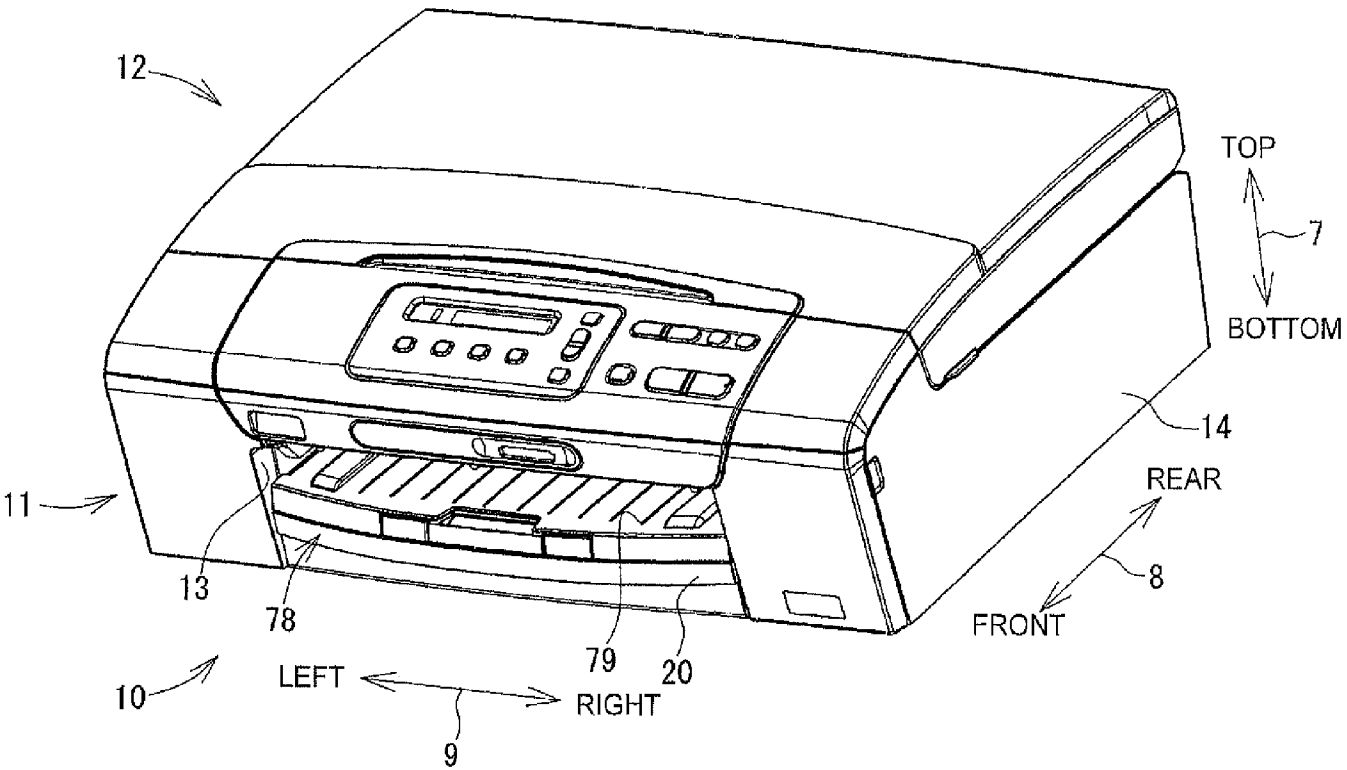
FIG. 1 is a perspective view showing the exterior of a multifunction apparatus, which is an example of an embodiment of the present invention.

Referring to the drawings, preferred embodiments of the present invention will be described. Note that the embodiments to be described below are merely examples of the present invention, and the embodiments of the present invention can of course be appropriately modified within a scope not changing the gist of the present invention.

[Outline of Multifunction Apparatus]

FIG. 1 is a perspective view showing the exterior of a multifunction apparatus 10 according to a first embodiment of the present invention. In the following description, a top-bottom direction 7 is defined based on a state in which the multifunction apparatus 10 is installed in a usable manner (a state shown in FIG. 1), a front-rear direction 8 is defined such that the side having an opening 13 is the near side (front), and the left-right direction 9 is defined by viewing the multifunction apparatus 10 from the near side (front).

The multifunction apparatus 10 is formed in a substantially thin rectangular parallelepiped shape whose width (the length in the left-right direction 9) and depth (the length in the front-rear direction 8) are larger than the height (the length in the top-bottom direction 7). The multifunction apparatus 10 includes, mainly, a printer unit 11 provided at the lower part and employing an inkjet recording method and a scanner unit 12 provided at the upper part, which are configured as a single unit. The multifunction apparatus 10 has various functions, such as a facsimile function, a printer function, a scanner function, and a copying function. The multifunction apparatus 10 has a duplex image recording function to record images on both the front side (first side) and the back side (second side) of a recording sheet. Because the functions other than the printer function are optional, the image recording apparatus of the present invention may be embodied as a printer with no scanning function, copying function, or facsimile function.

The printer unit 11 has a casing (housing) 14 (an example of a body) having the opening 13 in the front. The components of the printer unit 11 are disposed in the casing 14. A storing chamber is defined such that it extends from the opening 13 to the inside of the casing 14, and a sheet-feed cassette 78 is fitted into the storing chamber. The sheet-feed cassette 78 is insertable into and removable from the casing 14 through the opening 13, in the front-rear direction 8 (horizontal direction). The sheet-feed cassette 78 includes a main tray 20 (an example of a tray) that can store recording sheets (an example of a recording medium) of various sizes, such as A3-sized recording sheets (A3 sheets), A4-sized recording sheets (A4 sheets), etc., and a slide guide 34 (an example of a guide member and a reference position moving mechanism) that is supported above the main tray 20 in a slidable manner. The configuration of the sheet-feed cassette 78 will be described in detail below.

[Configuration of Printer Unit]

Figure 2:
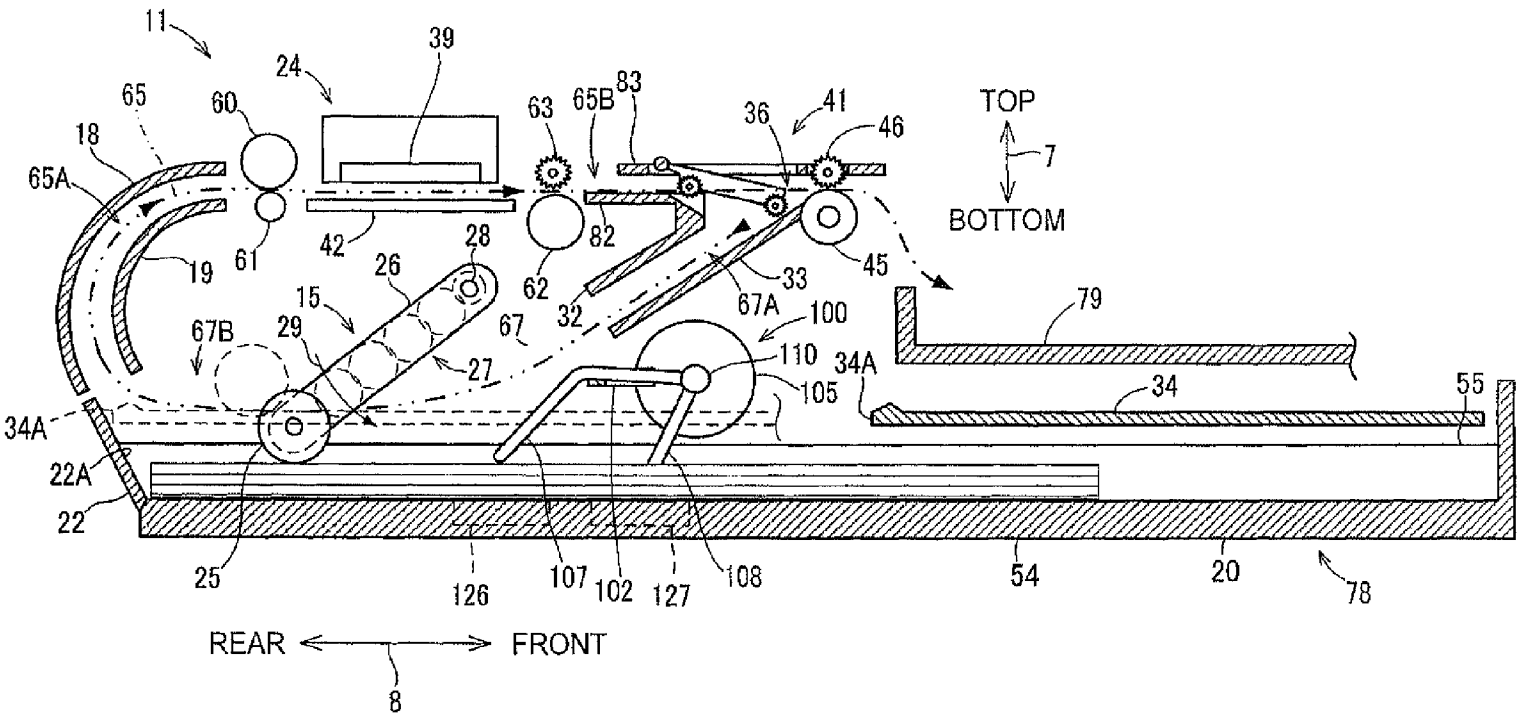
FIG. 2 is a vertical cross section schematically showing the inner structure of a printer unit.

Now, referring to FIG. 2, the configuration of the printer unit 11 will be described. FIG. 2 is a vertical cross section schematically showing the inner structure of the printer unit 11. FIG. 2 shows a state in which A4-sized recording sheets are stored.

The printer unit 11 includes the sheet-feed cassette 78; a feed unit 15 that picks up a recording sheet from the sheet-feed cassette 78 to sheet-feed (feed) the sheet; a recording unit 24 employing an inkjet recording method, which discharges ink droplets onto the recording sheet fed by the feed unit 15 to form an image thereon; a path-switching portion 41; a sheet-output tray 79 for holding recording sheets after recording, outputted to the outside; a detection mechanism 100; and a control unit 130 (an example of a control unit, see FIG. 4) that controls the operation of the printer unit 11. These components are provided in the casing 14. Note that the recording unit 24 is not necessarily limited to one employing an inkjet method, but may be one employing electrophotographic method, a thermal recording method, or the like. The sheet-output tray 79 may be formed as a single part with the sheet-feed cassette 78, or it may be fixed to the frame of the printer unit 11. Because the control unit 130 is a known arithmetic device having an arithmetic element, such as a central processing unit (CPU), and storage elements, such as a read-only memory (ROM) and a random access memory (RAM), a detailed description is omitted here.

[Conveying Path]

The printer unit 11 has a conveying path 65 formed therein which extends from an end (the rear end) of the main tray 20 via the recording unit 24 to the sheet-output tray 79. The conveying path 65 is divided into a curved path 65A, which is formed between the end of the main tray 20 and the recording unit 24, and a sheet-output path 65B, which is formed between the recording unit 24 and the sheet-output tray 79.

As shown in FIG. 2, the curved path 65A extends from the vicinity of the upper end of an inclined separator plate 22 provided in the main tray 20 to the recording unit 24. The curved path 65A is defined by an outer guide member 18 and an inner guide member 19 that are opposed to each other with a predetermined distance therebetween. The outer guide member 18 and the inner guide member 19 are formed in substantially arch shapes having the centers located inside the printer unit 11. Note that the outer guide member 18, the inner guide member 19, an upper guide member 83, a lower guide member 82, an upper inclined guide member 32, and a lower inclined guide member 33 (described below) all extend perpendicular to the plane of the sheet of FIG. 2 (the left-right direction 9 in FIG. 1).

The sheet-output path 65B is defined by the lower guide member 82 and the upper guide member 83 provided on the downstream side of the recording unit 24 in the conveying direction (hereinafter referred to as the "downstream side"). Herein, the conveying direction means a direction in which the recording sheet is conveyed along the conveying path 65 or a reverse-conveying path 67 (described below) (the direction indicated by a two-dot chain line with arrow heads in FIG. 2).

Figure 3A:
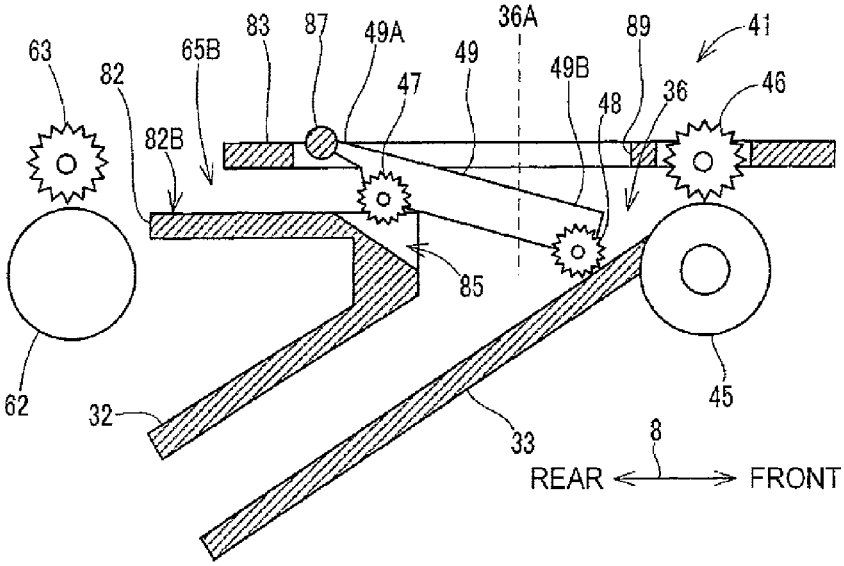
FIGS. 3A and 3B are partial enlarged cross sections showing the structure near a sheet output path.
Figure 3B:
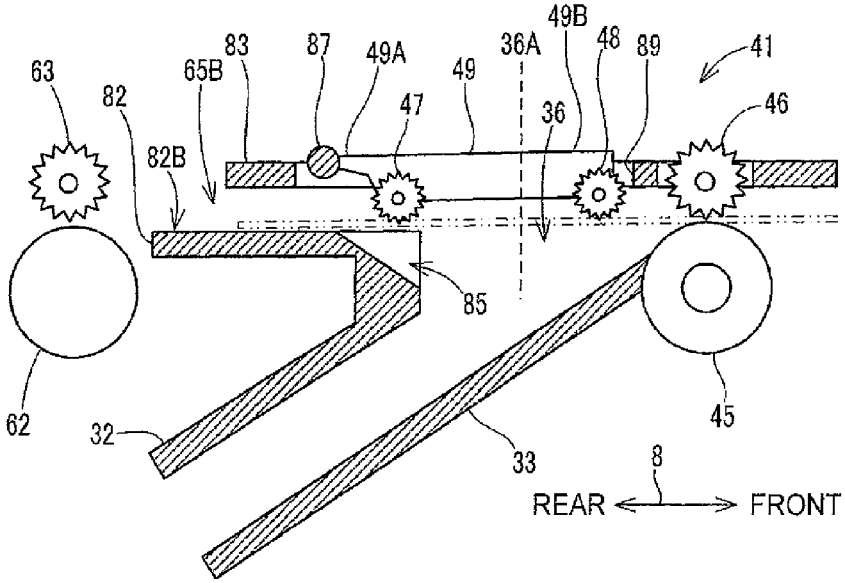

FIGS. 3A and 3B are partial enlarged cross sections showing the structure near the sheet output path 65B. As shown in FIGS. 3A and 3B, the lower guide member 82 horizontally extends to the front side (the right side in FIGS. 3A and 3B) from the nip position of a second conveying roller 62 and a spur roller 63 (described below). The sheet output path 65B guides the recording sheet after image recording, conveyed by the second conveying roller 62, to the downstream side by supporting the lower side of the sheet. A branch port 36 is formed on the downstream side of the downstream end of the lower guide member 82. When duplex image recording is to be performed, the recording sheet conveyed along the sheet output path 65B is switched back on the downstream side of the branch port 36 and is then conveyed downward from the branch port 36.

The lower guide member 82 has a long, narrow recess 85 extending in the front-rear direction 8. The recess 85 is formed at the downstream end of the lower guide member 82. The recess 85 has a long, narrow shape extending in the front-rear direction 8, and the downstream side thereof is open to the branch port 36. The size and position of the recess 85 are designed such that an auxiliary roller 47 (described below) can be inserted into the recess 85.

The upper guide member 83 is provided above the lower guide member 82. The upper guide member 83 and the lower guide member 82 are opposed to each other with a predetermined distance, allowing a recording sheet to pass, therebetween. The upper guide member 83 extends beyond the branch port 36 to a position above the sheet-output tray 79.

[Reverse-Conveying Path]

As shown in FIG. 2, the printer unit 11 has, inside thereof, the reverse-conveying path 67. The reverse-conveying path 67 branched from the sheet output path 65B at the branch port 36 extends between the sheet-feed cassette 78 and the recording unit 24 provided thereabove and joins to a merging point on the upstream side of the recording unit 24 in the conveying direction (hereinafter referred to as the "upstream side"). Note that the merging point is a position where the beginning end (upstream end) of the curved path 65A merges with the terminal end (downstream side end) of the reverse-conveying path 67.

The reverse-conveying path 67 is defined by the upper inclined guide member 32 and the lower inclined guide member 33 having inclined surfaces that extend obliquely downward to the rear from the branch port 36. In this embodiment, the upper inclined guide member 32 and the lower inclined guide member 33 define a part of the reverse-conveying path 67, more specifically, an inclined path 67A on the branch port 36 side. The upper inclined guide member 32 and the lower guide member 82 are formed as a single part. The guide members 32 and 33 are opposed to each other with a predetermined distance, allowing a recording sheet to pass, therebetween. The upper inclined guide member 32 is disposed above the lower inclined guide member 33. These guide members 32 and 33 extend downward from the branch port 36, and, more specifically, they extend obliquely downward to the rear.

The reverse-conveying path 67 is defined also by a slide guide 34 (described below) provided on the sheet-feed cassette 78. When the slide guide 34 is disposed at a guide position shown by a dashed line in FIG. 2, the top surface of the slide guide 34 defines a part of the reverse-conveying path 67, more specifically, a straight path 67B extending linearly on the curved path 65A side. The slide guide 34 will be described below.

Because the conveying path 65 and the reverse-conveying path 67 are formed in this manner, a recording sheet fed by the feed unit 15 from the main tray 20 is conveyed to the recording unit 24 through the curved path 65A. In this conveying process, the recording sheet is reversed by the outer guide member 18 and the inner guide member 19 such that the side opposite the side having been in contact with a sheet-feed roller 25 of the feed unit 15 faces the recording unit 24. The recording sheet having passed the recording unit 24 travels through the sheet output path 65B and is conveyed to the sheet-output tray 79. Alternatively, the path-switching portion 41 switches the conveying path, and the recording sheet passes through the reverse-conveying path 67 and is again conveyed to the recording unit 24. The path-switching portion 41 will be described below.

[Recording Unit]

As shown in FIG. 2, the recording unit 24 is disposed above the sheet-feed cassette 78. The recording unit 24 is configured to reciprocate along a guide rail (not shown) extending in the direction perpendicular to the plane of the sheet of FIG. 2 (a main scanning direction). A platen 42 is provided below the recording unit 24. The platen 42 supports the recording sheet horizontally during image recording by the recording unit 24. While reciprocating in the main scanning direction, the recording unit 24 discharges fine droplets of ink, supplied from an ink cartridge (not shown), through nozzles 39 onto the recording sheet conveyed on the platen 42. Thus, an image is recorded on the recording sheet.

A first conveying roller 60 and a pinch roller 61, forming a pair, are provided between the terminal end of the curved path 65A and the recording unit 24, i.e., between the downstream end of the curved path 65A and the recording unit 24. The pinch roller 61 is disposed below the first conveying roller 60 and is urged against the roller surface of the first conveying roller 60 by an elastic member, such as a spring (not shown). The first conveying roller 60 and the pinch roller 61 nip the recording sheet conveyed along the curved path 65A and send the sheet onto the platen 42.

Furthermore, the second conveying roller 62 and the spur roller 63, forming a pair, are provided between the recording unit 24 and the beginning end of the sheet-output path 65B, i.e., between the recording unit 24 and the upstream end of the sheet-output path 65B. The spur roller 63 is disposed above the second conveying roller 62 and is urged against the roller surface of the second conveying roller 62 by its own weight or a spring. The second conveying roller 62 and the spur roller 63 nip the recording sheet after recording and convey the sheet toward further downstream side (toward the sheet-output tray 79).

A rotational driving power transmitted by a conveying motor (not shown) through a drive-transmission mechanism (not shown) rotates the first conveying roller 60 and the second conveying roller 62. The first conveying roller 60 and the second conveying roller 62 are driven in an intermittent manner during image recording. Thus, image recording is performed while the recording sheet is sent at a predetermined line width. In this embodiment, the rotational driving power that rotates the third conveying roller 45 in a forward rotation direction or in a reverse rotation direction is also supplied by the conveying motor. Thus, an example of the drive-transmission mechanism for transmitting driving power to the first conveying roller 60 and the second conveying roller 62 is a mechanism having a planetary gear that allows the first conveying roller 60 and the second conveying roller 62 to rotate in one direction to convey the recording sheet in one direction (to the right in FIG. 2) in either case where the conveying motor is rotated in the forward rotation direction or in the reverse rotation direction. When the driving source for the first conveying roller 60 and the second conveying roller 62 is provided separately from the driving source for the third conveying roller 45, the configuration of the drive-transmission mechanism is not limited to one having a planetary gear.

[Feed Unit]

The feed unit 15 is provided between the recording unit 24 and the sheet-feed cassette 78. The feed unit 15 conveys the recording sheets stored in the sheet-feed cassette 78 toward the curved path 65A. The feed unit 15 includes the sheet-feed roller 25, a sheet-feed arm 26, and a drive-transmission mechanism 27. The sheet-feed roller 25 supported so as to be rotatable at an end of the sheet-feed arm 26 picks up a recording sheet stored in the main tray 20 of the sheet-feed cassette 78 and feeds the sheet to the curved path 65A. The sheet-feed roller 25 is rotationally driven when a rotational force exerted by a sheet-feed motor (not shown), which is an example of a driving source, is transmitted through the drive-transmission mechanism 27. The drive-transmission mechanism 27 is supported by the sheet-feed arm 26 and includes a plurality of gears that are arranged substantially linearly in the direction in which the sheet-feed arm 26 extends.

A base shaft 28 is provided between the recording unit 24 and the sheet-feed cassette 78. The sheet-feed arm 26 is supported by the base shaft 28 at the base end thereof and is rotatable about the base shaft 28. Thus, the sheet-feed arm 26 can move vertically toward and away from the main tray 20. Furthermore, the sheet-feed arm 26 is rotationally urged in the direction indicated by an arrow 29 in FIG. 2 by its own weight or an elastic force exerted by an elastic member, such as a spring. Therefore, the feeding roller 25 can be urged against the top surface of the recording sheets stored in, for example, the main tray 20. Furthermore, when the slide guide 34 is disposed at the guide position (the position shown by the dashed line in FIG. 2), the feeding roller 25 can be urged against the top surface of the recording sheets placed on the slide guide 34. When the sheet-feed cassette 78 is inserted into the printer unit 11, the rear end (for example, the inclined separator plate 22) of the sheet-feed cassette 78 pushes the sheet-feed arm 26 upward. Furthermore, when the slide guide 34 is slid from an initial position shown in FIG. 2 to the guide position, the rear end of the slide guide 34 pushes the sheet-feed arm 26 upward.

[Path-Switching Portion]

Referring to FIGS. 3A and 3B, the path-switching portion 41 will be described. The path-switching portion 41 is disposed near the branch port 36 of the sheet output path 65B, i.e., the connecting portion of the sheet output path 65B and the reverse-conveying path 67. As shown in FIGS. 3A and 3B, the path-switching portion 41 includes the third conveying roller 45, a spur roller 46, and a flap 49 having an auxiliary roller 47 and an auxiliary roller 48.

The third conveying roller 45 is provided on the downstream side of the recording unit 24 and the lower guide member 82. The branch port 36 is formed between the third conveying roller 45 and the lower guide member 82. The third conveying roller 45 is supported by, for example, the frame of the printer unit 11 so as to be rotatable. The spur roller 46 is disposed above the third conveying roller 45 and is urged against the roller surface of the third conveying roller 45 by its own weight or a spring. The spur roller 46 is supported at the downstream end of the upper guide member 83 so as to be rotatable. The third conveying roller 45 receives driving power in the forward rotation direction or in the reverse rotation direction transmitted from the conveying motor (not shown) and is rotationally driven in the forward rotation direction or in the reverse rotation direction. For example, when recording is performed on one side, the third conveying roller 45 is rotated in the forward rotation direction. As a result, the recording sheet nipped by the third conveying roller 45 and the spur roller 46 is conveyed to the downstream side and is output onto the sheet-output tray 79. On the other hand, when recording is performed on both sides, while the third conveying roller 45 and the spur roller 46 nip the rear end of the recording sheet, the rotation direction of the third conveying roller 45 is switched from the forward rotation direction to the reverse rotation direction.

The third conveying roller 45 and the spur roller 46 nip the recording sheet sent from the second conveying roller 62 and the spur roller 63. When the recording sheet enters the nip portion between the third conveying roller 45 and the spur roller 46, the third conveying roller 45 and the spur roller 46 nip the recording sheet and convey it toward the direction according to the rotation direction of the third conveying roller 45 (toward the sheet-output tray 79 or the reverse-conveying path 67). That is, the third conveying roller 45 and the spur roller 46 can convey the recording sheet to further downstream side along the sheet output path 65B (toward the sheet-output tray 79) and can convey the recording sheet to the reverse-conveying path 67.

The upper guide member 83 has a support shaft 87 that extends in a direction perpendicular to the plane of the sheet of FIGS. 3A and 3B (the left-right direction 9 in FIG. 1). The support shaft 87 is provided on the upstream side of the branch port 36. The support shaft 87A supports a base end 49A, on the upstream side, of the flap 49. The flap 49 extends toward substantially the downstream side from the support shaft 87. An extended end 49B of the flap 49 reaches a position above the branch port 36, more specifically, a position beyond a central portion 36A of the branch port 36 and close to the third conveying roller 45.

The flap 49 has the auxiliary rollers 47 and 48 supported by shafts, which are disposed at a distance from each other along the flap 49. The auxiliary roller 47 is supported by the shaft at the base end 49A of the flap 49. The auxiliary roller 48 is supported by the shaft at the extended end 49B of the flap 49. The roller surfaces of these auxiliary rollers 47 and 48 have, similarly to the spur rollers 63 and 46, a spur shape because they are brought into contact with the recording surfaces of the recording sheets.

The flap 49 rotates between an output orientation (the orientation shown in FIG. 3B) where it is positioned above the lower guide member 82 and a reverse orientation (the orientation shown in FIG. 3A) where the extended end 49B is positioned below the branch port 36. In this embodiment, the upper guide member 83 has an opening 89 into which the flap 49 can fit. When positioned at the output orientation, the flap 49 fits into the opening 89 and is retracted from the sheet output path 65B. When positioned at the reverse orientation, the flap 49 is exposed from the opening 89, and the auxiliary roller 48 comes into contact with the lower inclined guide member 33. Furthermore, when the auxiliary roller 47 fits into the recess 85 in the lower guide member 82, the auxiliary roller 47 is retracted below a support surface 82B of the lower guide member 82.

[Sheet-Feed Cassette]

As shown in FIG. 2, the sheet-feed cassette 78 is provided below the feed unit 15. The main tray 20 of the sheet-feed cassette 78 is disposed at the bottom of the printer unit 11. The main tray 20 can hold recording sheets of A3 size (297 mm×420 mm), letter size (216 mm×274 mm), legal size (216 min×356 mm), A4 size (210 mm×297 mm), and smaller sizes, such as postcard size, L-size (89 mm×127 mm), and business card size.

[Main Tray]

Figure 4:
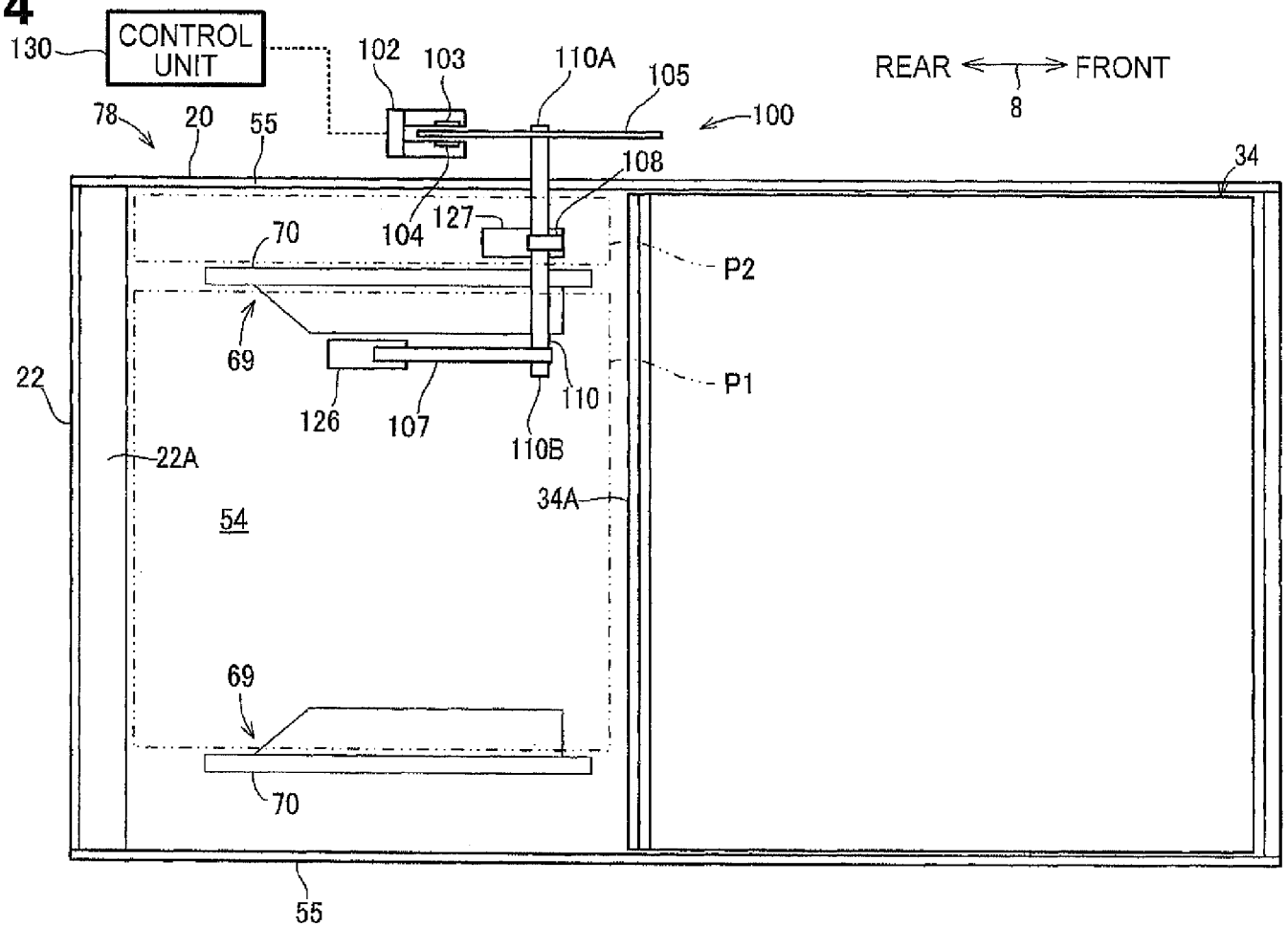
FIG. 4 is a plan view schematically showing the configuration of a sheet-feed cassette.

As shown in FIG. 4, the main tray 20 has a bottom plate 54 on which recording sheets are placed, side plates 55 that stand upright from both ends of the bottom plate 54 in the left-right direction 9, and the inclined separator plate 22 that stands upright from the rear end of the bottom plate 54. The main tray 20 has a substantially open-top rectangular box shape. The open top surface serves as an opening through which the recording sheets are inserted into the main tray 20. The inclined separator plate 22 is inclined to the rear so that the recording sheets can be smoothly fed. The inclined separator plate 22 has, on an inner surface 22A thereof, a plurality of teeth protruding (not shown). Thus, even if a plurality of recording sheets stacked are fed, the teeth separate only the top recording sheet when the ends of the recording sheets come into contact with the inner surface 22A of the inclined separator plate 22 and feed the sheet to the curved path 65A.

The main tray 20 has a pair of side guides 69 (an example of a side guide). The side guides 69 are provided on the top surface of the bottom plate 54. The side guides 69 regulate the side edges (both ends in the width direction) of the recording sheets stored in the main tray 20 to the position according to the recording sheet size, thereby positioning the recording sheets in the main tray 20 in the width direction. In this embodiment, the pair of side guides 69 regulate such that the central position of the recording sheets stored in the main tray 20 in the width direction is aligned with a predetermined reference position (for example, the center of the main tray 20 in the width direction). Regulating the recording sheets such that the central position thereof in the width direction is aligned with the reference position is usually called "center registration".

The pair of side guides 69 are supported so as to be slidable in the width direction of the main tray 20 (the direction perpendicular to the sheet-feed direction). The recording sheets are stored in the area enclosed by the pair of side guides 69. With the recording sheets stored in the main tray 20, when the side guides 69 are slid toward the center, perpendicular walls 70 of the side guides 69 come into contact with the side edges of the recording sheets, thereby regulating the side edges and positioning the recording sheets. A known cooperative slide mechanism consisting of pinions provided on the bottom plate 54 and racks provided on the side guides 69 is employed as a slide mechanism for sliding the pair of side guides 69. Thus, when one of the side guides 69 is slid, the other is also slid in cooperation therewith.

As shown in FIG. 4, the bottom plate 54 of the main tray 20 has slots 126 and 127 extending in the front-rear direction 8. The slot 126 is provided at a position corresponding to a first rotor 107 (described below) and the slot 127 is provided at a position corresponding to a second rotor 108 (described below). When no recording sheet is stored in the main tray 20, the end of the first rotor 107 is in the slot 126 and the end of the second rotor 108 is in the slot 127 (see FIG. 5B). When at least one recording sheet is stored in the main tray 20, the first rotor 107 and the second rotor 108 do not enter the slots 126 and 127 but are in contact with the top surface of a recording sheet S3.

[Slide Guide]

The slide guide 34 is provided above the main tray 20. The slide guide 34 is supported above the main tray 20 so as to be slidable in the front-rear direction 8. In this embodiment, as shown in FIG. 2, the slide guide 34 is slidable between the initial position (corresponding to an initial position) located on the front side of the main tray 20 and the guide position (corresponding to a guide position), shown by the dashed line in FIG. 2, shifted toward the rear from the initial position. The guide position is a position where a rear end 34A of the slide guide 34 is close to the inclined separator plate 22. At this guide position, the slide guide 34 guides the recording sheet after image recording, having been conveyed along the reverse-conveying path 67, to the curved path 65A. In addition, the initial position is a position where the rear end 34A of the slide guide 34 is located away from the first rotor 107 and the second rotor 108 of the detection mechanism 100 (described below) toward the front and where the first rotor 107 and the second rotor 108 can be lowered toward the main tray 20.

Examples of a slide-support mechanism for the slide guide 34 relative to the main tray 20 include a known slide-support mechanism consisting of rails (not shown) provided on the upper ends of the side plates 55 of the main tray 20 and rail slots (not shown) provided in the slide guide 34. The description of this slide-support mechanism will be omitted.

In this embodiment, driving power from a conveying motor (M) is transmitted through the drive-transmission mechanism to the slide guide 34. Thus, the slide guide 34 is slid in the front-rear direction 8, i.e., the direction in which the driving power is applied. For example, when the recording sheet is conveyed to the reverse-conveying path 67, the driving power toward the rear is transmitted to the slide guide 34 located at the initial position to move the slide guide 34 to the guide position. When the recording sheet is guided from the reverse-conveying path 67 to the curved path 65A, the driving power toward the front is transmitted to the slide guide 34, to move the slide guide 34 from the guide position to the initial position. In addition, when the multifunction apparatus 10 is turned on, the driving power is transmitted to the slide guide 34, so that a certain preparation operation is performed on the slide guide 34. More specifically, after power is turned on, the slide guide 34 is moved to the initial position, to the guide position, and again to the initial position. The control unit 130, a driver for the conveying motor (not shown), or the like controls the movement of the slide guide 34.

When the slide guide 34 is disposed at the initial position (see FIGS. 2 and 5B), the rear top surface of the main tray 20 is open. At this time, the feeding roller 25 is not supported by the slide guide 34 but is lowered toward the main tray 20 and comes into contact with the recording sheets stored in the main tray 20. When the feeding roller 25 is rotated in this state, the recording sheets stored in the main tray 20 are fed to the curved path 65A. In addition, when the slide guide 34 is disposed at the initial position, the rotors 107 and 108 of the detection mechanism 100 (described below) are not supported by the slide guide 34 but are lowered toward the main tray 20 (see FIG. 5B).

On the other hand, when the slide guide 34 is slid from the initial position to the guide position (see FIGS. 2 and 5C), the rear end 34A of the slide guide 34 comes into contact with the sheet-feed arm 26, pushing the sheet-feed arm 26 upward. As a result, the feeding roller 25 is disposed on the slide guide 34. When the feeding roller 25 is disposed on the slide guide 34, the feeding roller 25 comes into contact with the top surface of the recording sheet having passed through the reverse-conveying path 67 and been guided to the top surface of the slide guide 34. When the feeding roller 25 is rotated in this state, the recording sheet supported by the top surface of the slide guide 34 is fed to the curved path 65A. Furthermore, in the sliding process from the initial position to the guide position, the first rotor 107 and the second rotor 108 are pushed upward and are disposed on the slide guide 30 (see FIG. 5C).

[Detection Mechanism]

The detection mechanism 100 detects the size of the recording sheets stored in the main tray 20 and, as shown in FIG. 2, includes an optical sensor 102 (an example of a sensor of), a rotary disc 105 (an example of a moving member), the first rotor 107, and the second rotor 108. The first rotor 107 and the second rotor 108 are examples of actuators, and the second rotor 108 is also an example of a reference position moving mechanism. The first rotor 107 corresponds to the first rotor, and the second rotor 108 corresponds to the second rotor.

A support shaft 110 is provided above the sheet-feed cassette 78. The support shaft 110 is supported by the casing 14 or the like so as to be movable. As shown in FIG. 4, the support shaft 110 extends in the width direction of the main tray 20, i.e., in the direction perpendicular to the sheet-feed direction of the recording sheets, when the sheet-feed cassette 78 is fitted to the casing 14. One end 110A of the support shaft 110 extends beyond the side plate 55 of the main tray 20 to the outside, and the other end 110E extends toward the center in the width direction.

The rotary disc 105 consists of a plate-like member formed in a disc shape. The center of the rotary disc 105 is fixed to the end 110A of the support shaft 110. Thus, rotation of the support shaft 110 rotates the rotary disc 105 on the outside of the side plates 55. The rotary disc 105 is formed of a material that can reflect light emitted from the optical sensor 102. The rotary disc 105 has a plurality of openings 113, 115, and 117 (see FIGS. 5B and 5C) formed along the periphery. These openings 113, 115, and 117 are disposed at a predetermined distance from one another in the direction in which the rotary disc 105 rotates about the support shaft 110 (corresponding to a moving direction). Thus, in this embodiment, a light-blocking portion 114 is formed between the openings 113 and 115, and a light-blocking portion 116 is formed between the openings 115 and 117, and these light-blocking portions 114 and 116 are disposed at a predetermined distance from each other in the rotation direction of the rotary disc 105. Note that the light-blocking portion 114 is an example of a first blocking portion, and the light-blocking portion 116 is an example of a second blocking portion.

The optical sensor 102 is a transmission-type sensor, such as a photo-interrupter, and includes a light-emitting element 103 (an example of a light-emitting element) that emits light and a light-receiving element 104 (an example of a light-receiving element) that can receive light from the light-emitting element 103. The optical sensor 102 is electrically connected to the control unit 130 through a lead wire. An electric signal outputted from the light-receiving element 104 is transmitted to the control unit 130 through the lead wire. In this embodiment, as will be described below, the control unit 130 determines the size of the recording sheets stored in the main tray 20, on the basis of the waveform of the electric signal (see FIG. 8) from the light-receiving element 104.

As shown in FIG. 4, the light-emitting element 103 and the light-receiving element 104 are opposed to each other. The optical sensor 102 is provided at a position where the periphery of the rotary disc 105 is disposed at a gap portion between the light-emitting element 103 and the light-receiving element 104. Therefore, the light emitted from the light-emitting element 103 and traveling toward the periphery of the rotary disc 105 passes through the openings 113, 115, and 117 (see FIGS. 5B and 5C) provided in the periphery and is received by the light-receiving element 103, or the light is blocked by the light-blocking portions 114 and 116 (see FIGS. 5B and 5C).

The first rotor 107 and the second rotor 108 are fixed to the support shaft 110. Therefore, rotation of the support shaft 110 rotates the first rotor 107 and the second rotor 108. The first rotor 107 and the second rotor 108 are formed of rod-like members extending from the support shaft 110 toward the main tray 20 so as to be inclined to the rear. These rotors 107 and 108 serve to detect the presence/absence and size of the recording sheets stored in the main tray 20. In this embodiment, the first rotor 107 serves to determine the presence/absence of A4-sized recording sheets and to detect if the recording sheets are A4-sized, and the second rotor 108 serves to determine the presence/absence of A3-sized recording sheets and to detect if the recording sheets are A3-sized. The rotors 107 and 108 are formed in shapes suitable for their functions.

As shown in FIG. 4, the first rotor 107 and the second rotor 108 are disposed above the main tray 20. In this embodiment, the first rotor 107 is fixed at the end 110B and the second rotor 108 is fixed at the end 110A of the support shaft 110. Thus, the first rotor 107 and the second rotor 108 are separated in the direction in which the support shaft 110 extends. In this embodiment, the first rotor 107 is disposed at a position corresponding to the storage area for A4 sheets in the main tray 20, i.e., a position above the storage area for A4 sheets. More specifically, the first rotor 107 is disposed at a position above an area P1, enclosed by a two-dot chain line (see FIG. 4), that does not interfere with the slide guide 34 when the slide guide 34 is located at the initial position. Furthermore, the second rotor 108 is disposed at a position corresponding to an area where the non-storage area for A4 sheets in the main tray 20 (non-storage area) and the storage area for A3 sheets overlap. More specifically, the second rotor 108 is disposed at a position above an area P2, enclosed by a two-dot chain line (see FIG. 4), that does not interfere with the slide guide 34 when the slide guide 34 is located at the initial position.

Figure 5A:
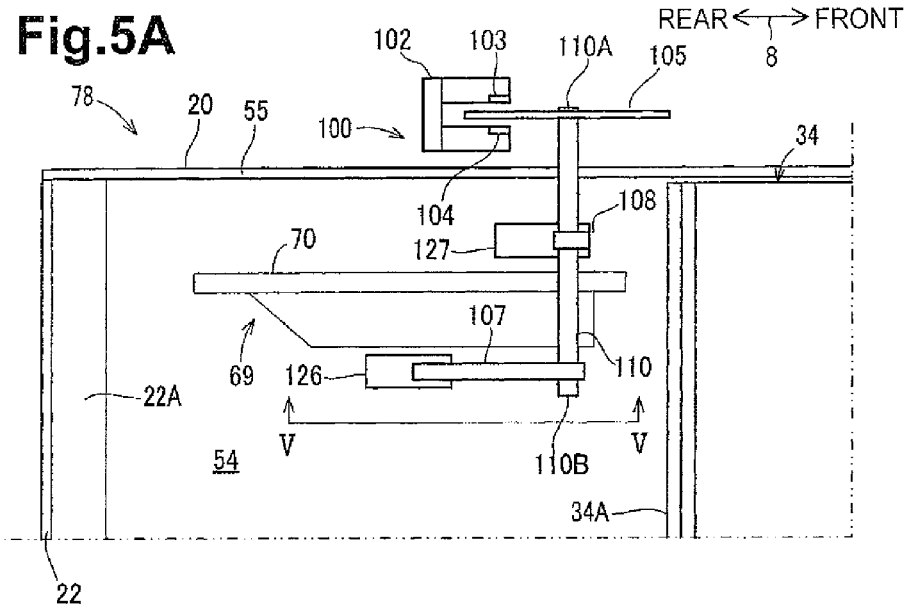
Figure 5B:
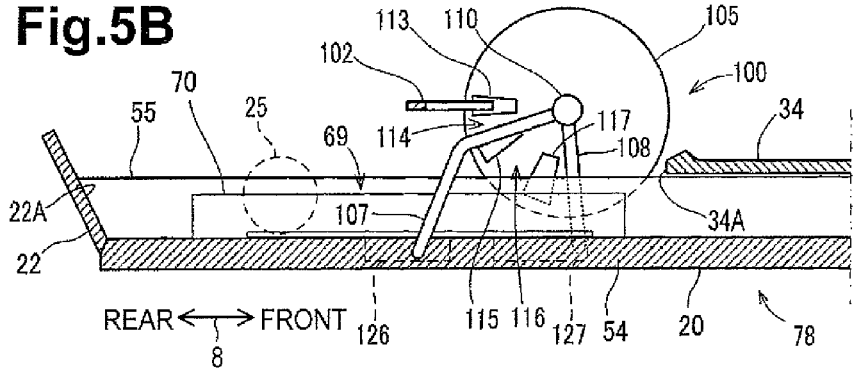
Figure 5C:
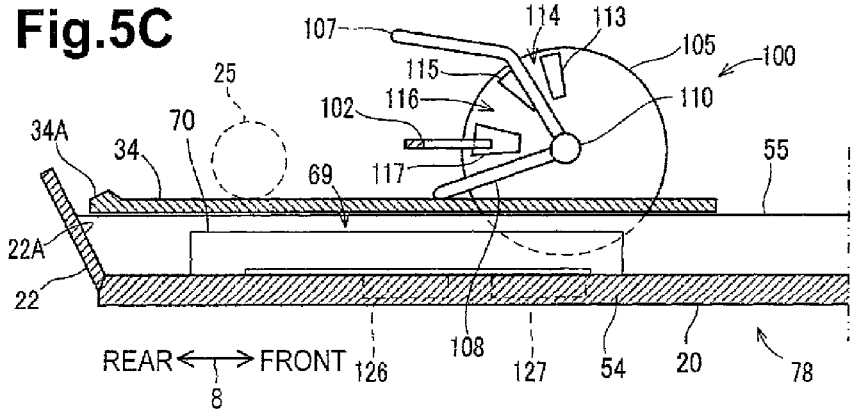

As shown in FIGS. 5B and 5C, the first rotor 107 and the second rotor 108 are fixed to the support shaft 110 in such a manner that they are shifted from each other by a predetermined angle in the rotation direction of the support shaft 110. More specifically, the first rotor 107 is shifted to the rear by a predetermined angle from the second rotor 108. In addition, as shown in FIG. 5B, when no recording sheet is stored in the main tray 20, the end of the first rotor 107 is in the slot 126, and the end of the second rotor 108 is in the slot 127.

[Preparation Operation of Slide Guide]

Referring to FIGS. 5 to 8, a preparation operation performed on the slide guide 34 when the multifunction apparatus 10 is turned on, and the movement of the detection mechanism 100 during the preparation operation will be described in detail below.

Figure 6A:
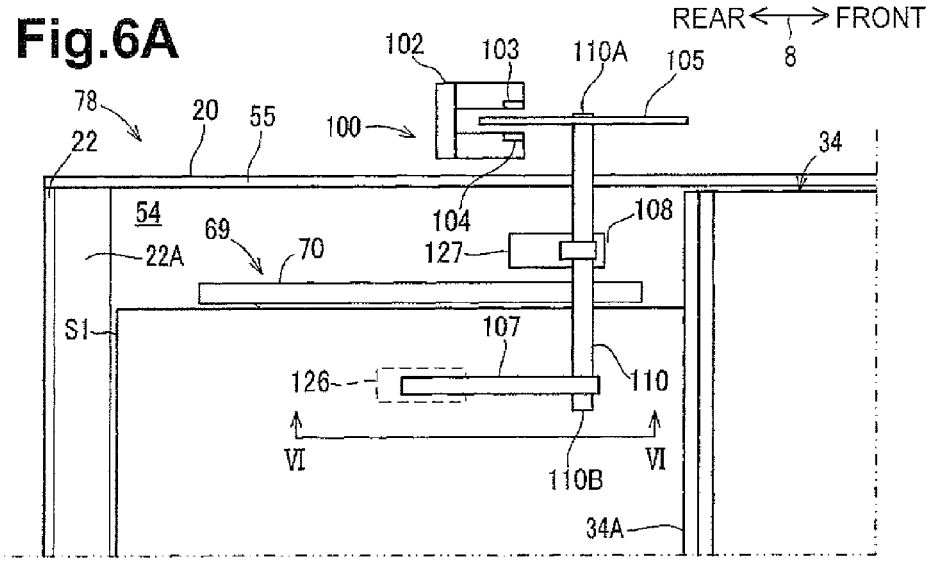
Figure 6B:
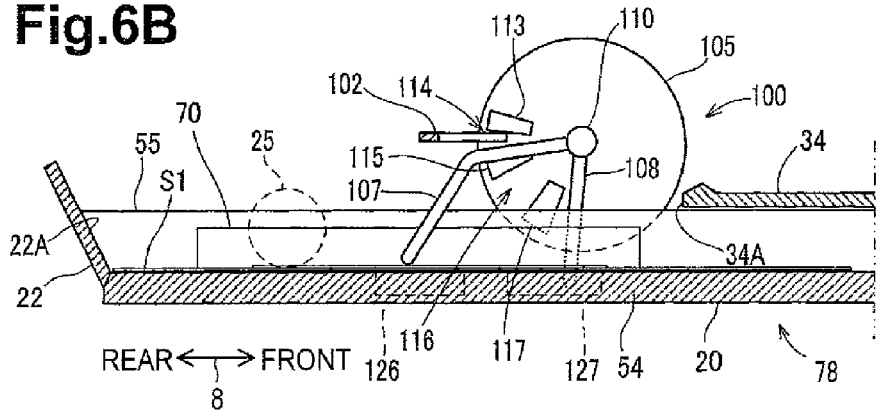
Figure 6C:
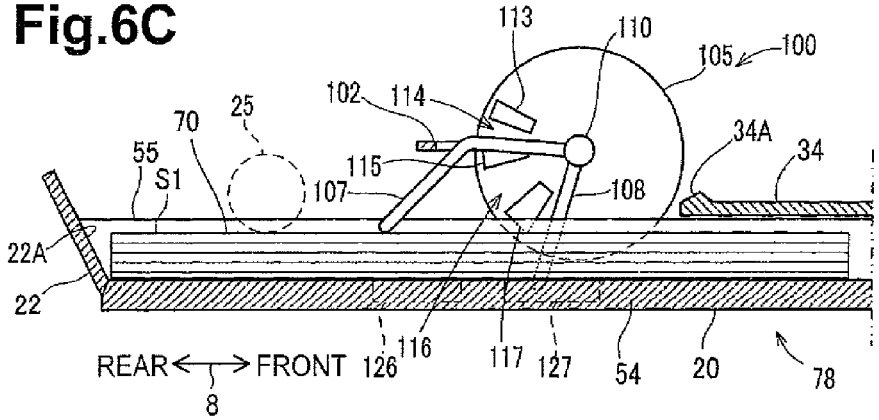

FIGS. 6A to 6C show states of the detection mechanism 100 when an A4-sized recording sheet (A4 sheet) S1 is stored in the main tray 20. FIG. 6B shows a schematic cross section when only one A4 sheet S1 is stored, and FIG. 6C shows a schematic cross section when a large number of A4 sheets S1 are stored. When the main tray 20 holding the A4 sheet S1 is fitted to the casing 14, the top surface of the A4 sheet S1 in the main tray 20 pushes up the first rotor 107. At this time, the rotary disc 105 rotates to a position where the light-blocking portion 114 is located at the gap portion of the optical sensor 102 (corresponding to a first position). In this embodiment, the position and shape of the first rotor 107 and light-blocking portion 114 are designed such that the light-blocking portion 114 is located at the aforementioned gap portion, as long as at least one A4 sheet S1 is stored in the main tray 20, regardless of the number of A4 sheets S1 stored.

Figures 8A, 8B, 8C:
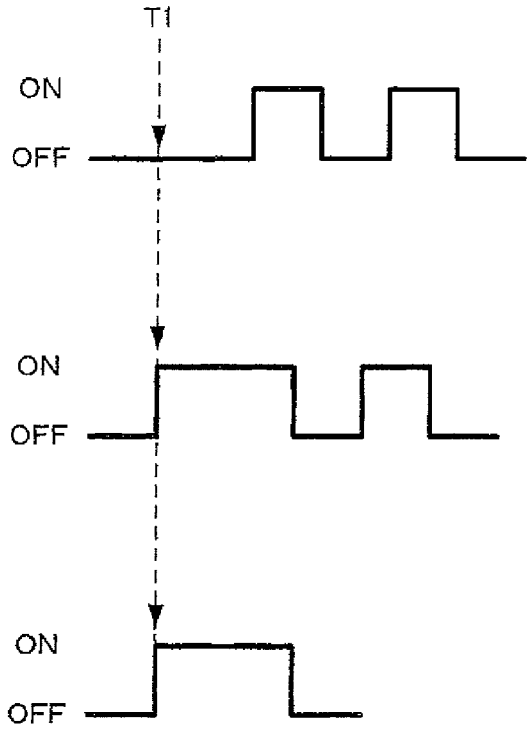
FIGS. 8A to 8C are waveform diagrams showing waveforms of output signals outputted from an optical sensor according to the presence/absence of recording sheets.

In this state, once the power is turned on and the preparation operation of the slide guide 34 is performed to dispose the slide guide 34 at the initial position (STEP1 in FIG. 10), as shown in FIG. 6B, the first rotor 107 is pushed up by the A4 sheet S1 and is ejected from the slot 126. Then, the first rotor 107 in contact with the top surface of the A4 sheet S1 stops. The rotary disc 105 stops with the light-blocking portion 114 located at the gap portion of the optical sensor 102. In this state, because the light emitted from the light-emitting element 103 of the optical sensor 102 is blocked, the control unit 130 receives a LOW level (ON) signal (hereinafter, "ON signal") from the light-receiving element 104. As shown in FIG. 8B, when the output signal of the optical sensor 102 is ON at time T1 when the power is turned on, the control unit 130 determines that a recording sheet is stored in the main tray 20.

Figure 10:
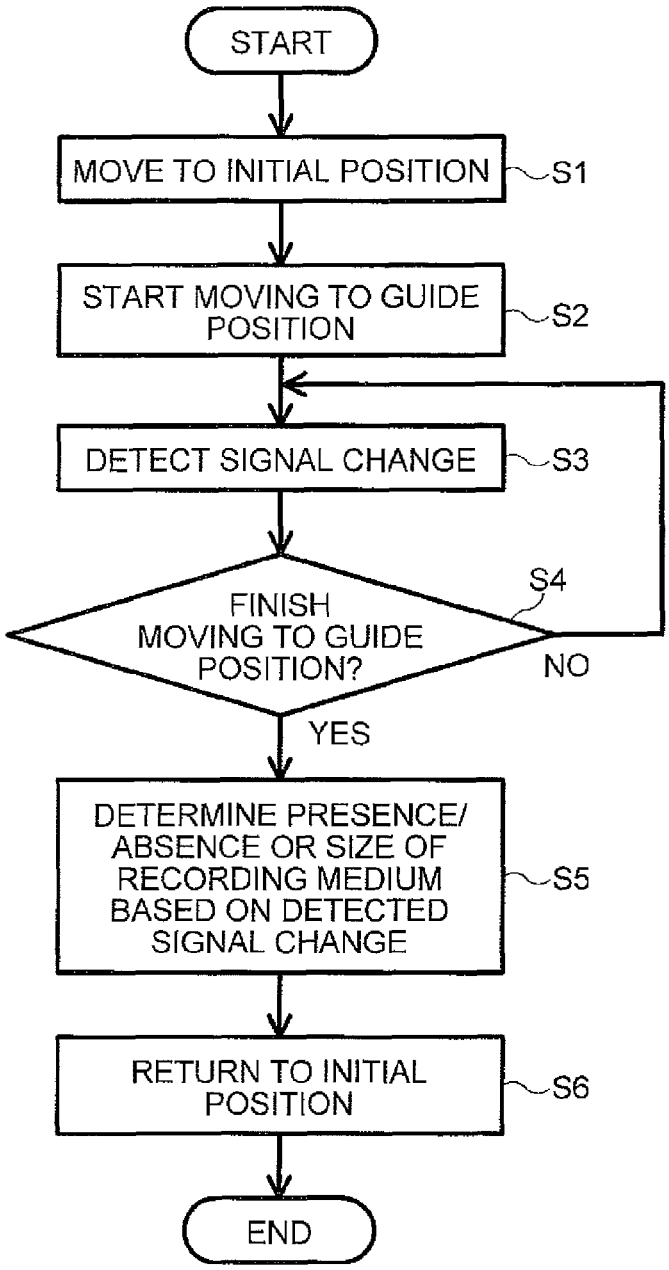
FIG. 10 is a flowchart showing a detecting process.

Thereafter, the preparation operation of the slide guide 34 is further continued to move the slide guide 34 from the initial position to the guide position (STEP2 in FIG. 10). At this time, the rear end 34A of the slide guide 34 pushes the second rotor 108 to the rear, rotating the first rotor 107 and the second rotor 108 clockwise in FIG. 6B. This rotates the support shaft 110 and the rotary disc 105 clockwise. Then, as shown in FIG. 5C, when the second rotor 108 moves onto the top surface of the slide guide 34, the rotation of the first rotor 107, second rotor 108, support shaft 110, and rotary disc 105 stops. At this time, the rotary disc 105 stops with the opening 117 located at the gap portion of the optical sensor 102 (corresponding to a reference position). That is, the rotation of the rotary disc 105 causes the light-blocking portion 114, the opening 115, and the light-blocking portion 116 to pass through the gap portion of the optical sensor 102. Therefore, the control unit 130 detects that the output signal of the optical sensor 102 changes with time, from ON to OFF to ON to OFF (STEP3 and STEP4 in FIG. 10), as shown in FIG. 8B. In the control unit 130, information indicating A4 size for such a signal change is stored in an inner memory in advance. Therefore, the control unit 130 determines that the size of the recording sheet stored in the main tray 20 is A4 size, on the basis of the signal change shown in FIG. 8B (STEP5 in FIG. 10). Then, the preparation operation of the slide guide 34 is performed to return the slide guide 34 to the initial position (STEP6 in FIG. 10).

Figure 7A:
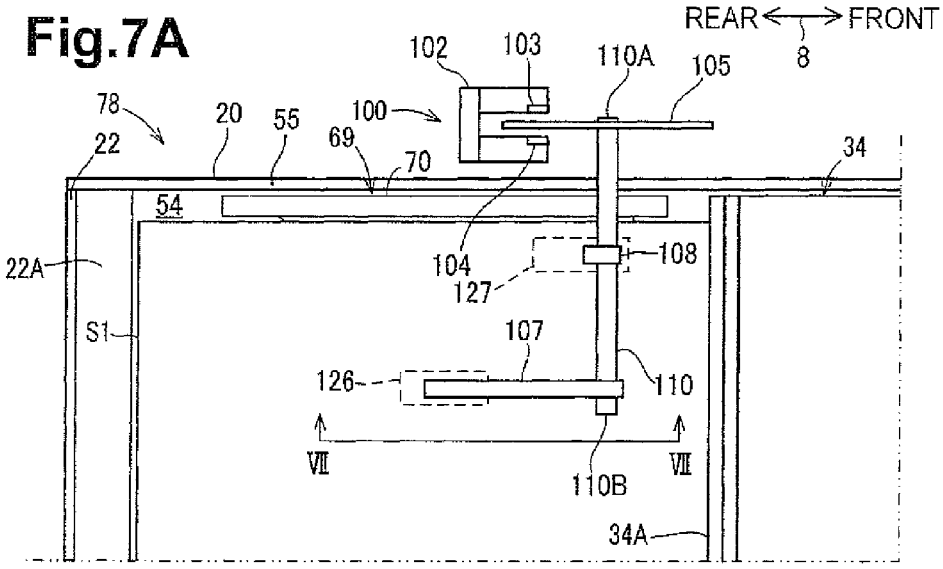
Figure 7B:
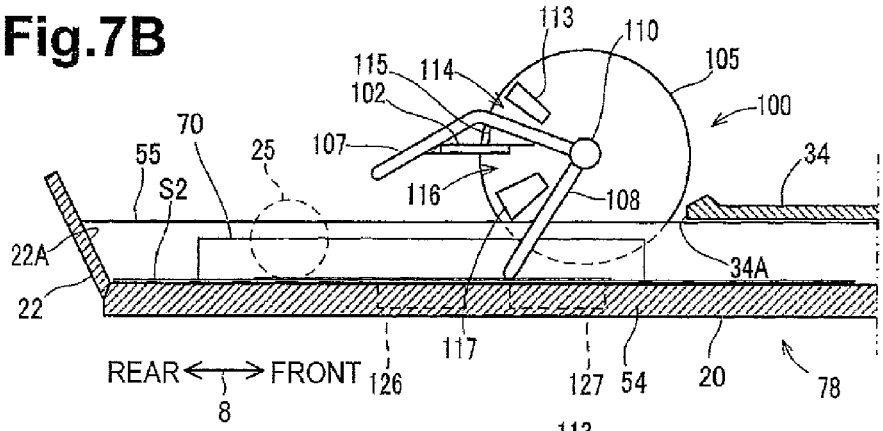
Figure 7C:
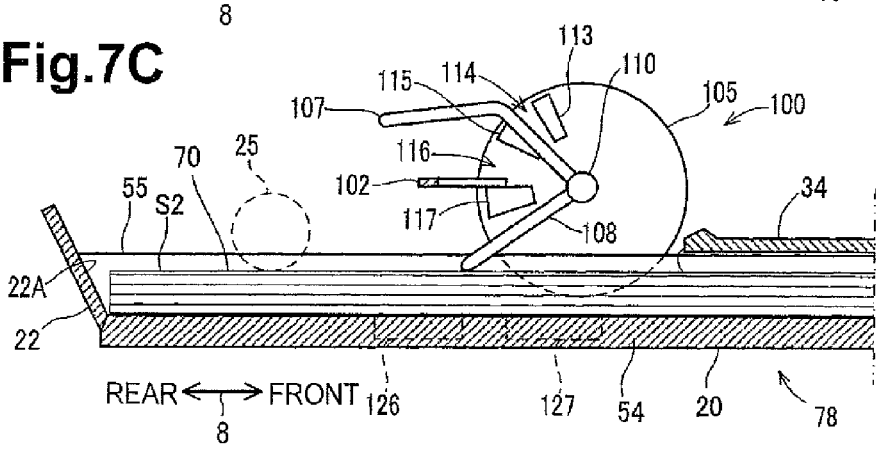

FIGS. 7A to 7C show states of the detection mechanism 100 when an A3-sized recording sheet (A3 sheet) S2 is stored in the main tray 20. FIG. 7B shows a schematic cross section when only one A3 sheet S2 is stored, and FIG. 7C shows a schematic cross section when a large number of A3 sheets S2 are stored. When the main tray 20 holding the A3 sheet S2 is fitted to the casing 14, the top surface of the A3 sheet S2 in the main tray 20 pushes up the second rotor 108. At this time, the rotary disc 105 rotates to a position where the light-blocking portion 114 passes through the gap portion of the optical sensor 102 and the light-blocking portion 116 is located at the gap portion (corresponding to a second position). In this embodiment, the position and shape of the second rotor 108 and light-blocking portion 116 are designed such that the light-blocking portion 116 is located at the gap portion, as long as at least one A3 sheet S2 is stored in the main tray 20, regardless of the number of A3 sheets S3.

In this state, once the power is turned on and the preparation operation of the slide guide 34 is performed to dispose the slide guide 34 at the initial position (STEP1 in FIG. 10), as shown in FIG. 7B, the second rotor 108 is pushed up by the A3 sheet S2 and is ejected from the slot 127. Then, the second rotor 108 in contact with the top surface of the A3 sheet S2 stops. The rotary disc 105 stops with the light-blocking portion 116 located at the gap portion of the optical sensor 102. In this state, because the light emitted from the light-emitting element 103 of the optical sensor 102 is blocked, the control unit 130 receives an ON signal from the light-receiving element 104. As shown in FIG. 8C, when the output signal of the optical sensor 102 is ON at time T1 when the power is turned on, the control unit 130 determines that a recording sheet is stored in the main tray 20.

Thereafter, the preparation operation of the slide guide 34 is further continued to move the slide guide 34 from the initial position to the guide position (STEP2 in FIG. 10). At this time, the rear end 34A of the slide guide 34 pushes the second rotor 108 to the rear, rotating the first rotor 107 and the second rotor 108 clockwise in FIG. 7B. This rotates the support shaft 110 and the rotary disc 105 clockwise. Then, as shown in FIG. 5C, when the second rotor 108 moves onto the top surface of the slide guide 34, the rotation of the first rotor 107, second rotor 108, support shaft 110, and rotary disc 105 stops. At this time, the rotary disc 105 stops with the opening 117 located at the gap portion of the optical sensor 102. That is, the rotation of the rotary disc 105 causes only the light-blocking portion 116 to pass through the gap portion of the optical sensor 102. Therefore, the control unit 130 detects that the output signal of the optical sensor 102 changes with time, from ON to OFF (STEP3 and STEP4 in FIG. 10), as shown in FIG. 8C. In the control unit 130, information indicating A3 size for such a signal change is stored in the inner memory in advance. Therefore, the control unit 130 determines that the size of the recording sheet stored in the main tray 20 is A3 size, on the basis of the signal change shown in FIG. 8C (STEP5 in FIG. 10). Then, the preparation operation of the slide guide 34 is performed to return the slide guide 34 to the initial position (STEP6 in FIG. 10).

FIGS. 5A to 5C show states of the detection mechanism 100 when no recording sheet is stored in the main tray 20. FIG. 5A shows a plan view of the detection mechanism 100. FIG. 5B shows a schematic cross section when the slide guide 34 is disposed at the initial position, and FIG. 5C shows a schematic cross section when the slide guide 34 is disposed at the guide position.

With no recording sheet stored in the main tray 20, when the power is turned on and then the preparation operation of the slide guide 34 is performed, the slide guide 34 is disposed at the initial position (STEP 1 in FIG. 10), as shown in FIG. 5B. The rotors 107 and 108 are stopped with the end of the first rotor 107 in the slot 126 and the end of the second rotor 108 in the slot 127. The support shaft 110 is also stopped at this time. The rotary disc 105 stops with the opening 113 located at the gap portion of the optical sensor 102 (corresponding to a third position). In this state, the light emitted from the light-emitting element 103 of the optical sensor 102 passes through the opening 113 and reaches the light-receiving element 104, without being blocked. Thus, the control unit 130 receives a HI-level (OFF) signal from the light-receiving element 104. As shown in FIG. 8A, when the output signal of the optical sensor 102 is OFF at time T1 when the power is turned on, the control unit 130 temporarily recognizes that no recording sheet is stored in the main tray 20.

Thereafter, the preparation operation of the slide guide 34 is continued to move the slide guide 34 from the initial position to the guide position (STEP2 in FIG. 10). At this time, the rear end 34A of the slide guide 34 pushes the second rotor 108 to the rear, rotating the first rotor 107 and the second rotor 108 clockwise. This rotates the support shaft 110 and the rotary disc 105 clockwise. Then, as shown in FIG. 5C, when the second rotor 108 moves onto the top surface of the slide guide 34, the rotation of the first rotor 107, second rotor 108, support shaft 110, and rotary disc 105 stops. At this time, the rotary disc 105 stops with the opening 117 located at the gap portion of the optical sensor 102. That is, the rotation of the rotary disc 105 causes the opening 113, the light-blocking portion 114, the opening 115, and the light-blocking portion 116 to pass through the gap portion of the optical sensor 102. Therefore, the control unit 130 detects that the output signal of the optical sensor 102 changes with time, from OFF to ON to OFF to ON to OFF (STEP3 and STEP4 in FIG. 10), as shown in FIG. 8A. In the control unit 130, information indicating no recording sheet for such a signal change is stored in an inner memory in advance. Therefore, the control unit 130 determines that no recording sheet is stored in the main tray 20, on the basis of the signal change shown in FIG. 8A (STEP5 in FIG. 10). Then, the preparation operation of the slide guide 34 is performed to return the slide guide 34 to the initial position (STEP6 in FIG. 10).

[Effect of Embodiment]

As has been described above, in this embodiment, because the output signal of the optical sensor 102 differs according to the presence/absence of recording sheets in the main tray 20, the control unit 130 can determine the presence/absence of recording sheets in the main tray 20 on the basis of the output signal. Furthermore, even when the recording sheets are changed while the multifunction apparatus 10 is turned OFF, by performing the preparation operation on the slide guide 34 when power is turned on, the control unit 130 can determine the size of the recording sheets stored in the main tray 20 on the basis of a change in signal outputted from the optical sensor 102 during the preparation operation. The multifunction apparatus 10 according to this embodiment has the very simple detection mechanism 100 having the optical sensor 102, serving as only detection means. Therefore, even when the recording sheets are changed while power is off, the presence/absence and size of the recording sheets can be precisely determined without increasing cost.

[Modification of Embodiment]

In the above-described embodiment, preparation operation performed on the slide guide 34 is used as means for rotating the rotary disc 105. However, for example, the rotary disc 105 may be rotated by directly applying rotational force to the support shaft 110, without using the slide guide 34.

In the above-described embodiment, the rotary disc 105, which is an example of the moving member, is used. However, a member of any shape may be used, as long as it has the light-blocking portion 114 and the light-blocking portion 116 capable of blocking the optical path of the optical sensor 102 depending on the rotation position of the first rotor 107 and the second rotor 108.

Furthermore, by using a mechanism for converting rotational movement of the support shaft 110 into linear movement (for example, a rack-pinion mechanism), a detector that operates linearly with the rotation of the support shaft 110 can be employed, in stead of the rotary disc 105. In this case, because the height of the detector is small, the thickness of the multifunction apparatus 10 can be reduced.

In the above-described embodiment, the opening 113 is disposed at the gap portion of the optical sensor 102 when the sheet-feed cassette 78 having no recording sheet in the main tray 20 is fitted to the casing 14. However, for example, the rotary disc 105 may be configured such that the opening 113 is located at the gap portion of the optical sensor 102 when the sheet-feed cassette 78 is removed from the casing 14. The position of the rotary disc 105 at this time corresponds to the third rotation position. In this case, the control unit 130 can determine that the sheet-feed cassette 78 is not fitted to the casing 14, on the basis of the ON signal from the optical sensor 102 transmitted when the power is turned on.

Figure 9A:
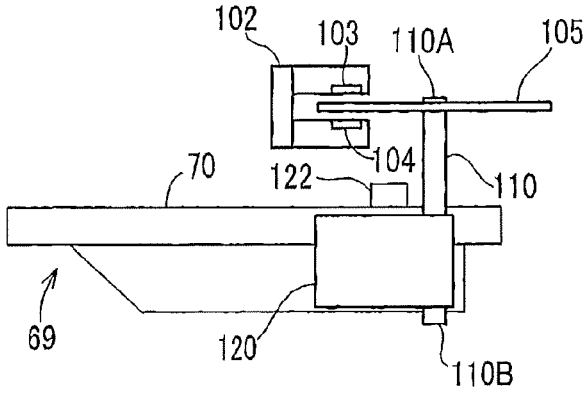
FIGS. 9A to 9C are schematic views for describing the mechanisms of a rotary plate and the vicinity thereof, according to a modification of this embodiment.
Figure 9B:
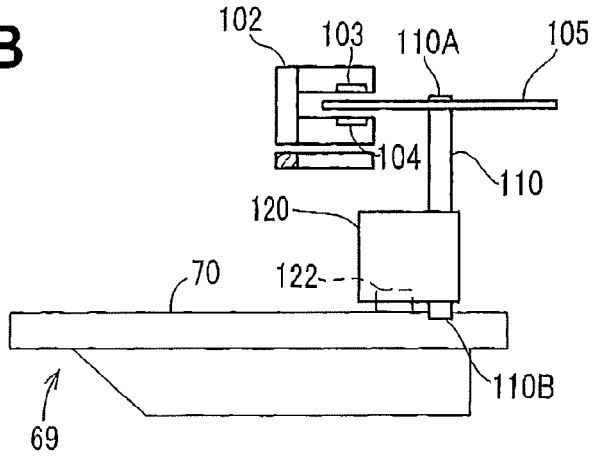
Figure 9C:
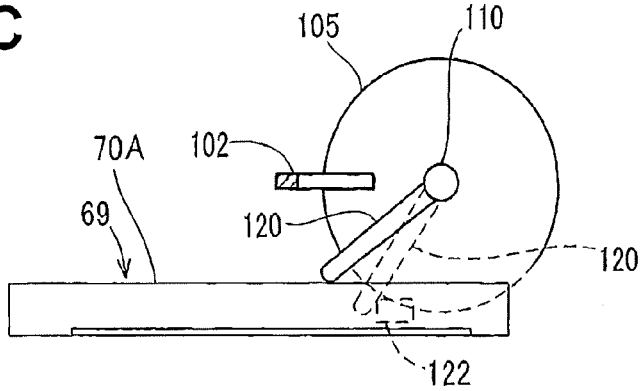

In the above-described embodiment, the first rotor 107 and the second rotor 108, which are an example of an actuator, are used. However, as shown in FIGS. 9A to 9C, a modification in which one rotary plate 120 is used instead of the rotors 107 and 108 is also possible. FIGS. 9A to 9C are schematic views for describing the mechanism of the rotary plate 120 and the vicinity thereof. FIG. 9A shows a partial plan view when the side guides 69 are located at positions corresponding to A3 size, and FIG. 9B shows a partial plan view when the side guides 69 are located at positions corresponding to A4 size. Furthermore, FIG. 9C shows a side view of the rotary plate 120. A dashed line in FIG. 9C shows the rotary plate 120 in a state shown in FIG. 9B.

The rotary plate 120 (an example of an actuator) is fixed to the support shaft 110, similarly to the rotors 107 and 108, and extends toward the main tray 20. Furthermore, a perpendicular wall 70 of the side guide 69 has, on the outer surface thereof, a projection 122 (an example of a first support member). The projection 122 protrudes outside from the outer surface, at a position lower than an upper end 70A (an example of a second support member) of the perpendicular wall 70. In this modification, when the sheet-feed cassette 78 is fitted to the casing 14 and the side guide 69 is located at a position corresponding to A3 size as shown in FIG. 9A, the upper end 70A of the perpendicular wall 70 supports the lower end of the rotary plate 120. In addition, when the side guide 69 is located at a position corresponding to A4 size as shown in FIG. 9B, the projection 122 supports the side edge of the rotary plate 120. When this rotary plate 120 is used, if at least one recording sheet is stored in the main tray 20 and the side guides 69 are located at positions corresponding to the recording sheet, the rotary plate 120 rotates in accordance with the size of the recording sheet, rotating the rotary disc 105. This rotary plate 120 also allows the control unit 130 to determine the size of the recording sheet, as long as at least one recording sheet is stored, similarly to the above-described embodiment.

In the above-described embodiment, the control unit 130 determines the size of the recording sheet stored in the main tray 20 based on the change of the output signals of the optical sensor 102 when the slide guide 34 moves from the initial position to the guide position. However, the control unit 130 may determine the size of the recording sheet stored in the main tray 20 based on the change of the output signals of the optical sensor 102 when the slide guide 34 moves from the guide position to the initial position.

Furthermore, the control unit 130 may determine that the sheet-feed cassette 78 is not fitted to the casing 14 based on the change of the output signals of the optical sensor 102.

What is claimed is:

1. An image recording apparatus comprising:

a body;

a tray capable of holding a first recording medium having a first size and a second recording medium having a second size;

a moving member movable to a first position, a second position, a third position and a reference position, wherein the moving member positions at the first position when the first recording medium is held on the tray, positions at the second position when the second recording medium is held on the tray, and positions at the third position when neither the first recording medium nor the second recording medium is held on the tray;

an actuator configured to contact a top surface of the first recording medium to move the moving member to the first position when the first recording medium is held on the tray, contact a top surface of the second recording medium to move the moving member to the second position when the second recording medium is held on the tray, and move the moving member to the third position when neither the first recording medium nor the second recording medium is held on the tray;

a sensor configured to output an ON signal or an OFF signal based on positions of the moving member, the positions including the first position, the second position, the third position and the reference position;

a reference position moving mechanism configured to, when the first recording medium is held on the tray, move the actuator away from the first recording medium to move the moving member to the reference position, and when the second recording medium is held on the tray, move the actuator away from the second recording medium to move the moving member to the reference position; and a control unit that determines a detection position based on a detection of a sequence of change of the ON signal and the OFF signal of the sensor when the moving member is moved between the detection position and the reference position by the reference position moving mechanism, wherein the control unit determines that a recording medium held on the tray is the first recording medium when the detection position is detected to be the first position and that a recording medium held on the tray is the second recording medium when the detection position is detected to be the second position.

2. The image recording apparatus according to claim 1, wherein the sensor is an optical sensor having a light-emitting element that emits light and a light-receiving element that receives light from the light-emitting element.

3. The image recording apparatus according to claim 1, wherein the first recording medium is different from the second recording medium in width.

4. The image recording apparatus according to claim 1, wherein the control unit controls the moving member to move to the reference position by applying driving power to the reference position moving mechanism upon turning on of power.

5. The image recording apparatus according to claim 1, wherein the moving member has a first blocking portion and a second blocking portion disposed at a predetermined distance from each other in a moving direction, and wherein the first position is a position where the first blocking portion blocks information from the sensor, and the second position is a position where the second blocking portion blocks information from the sensor after the first blocking portion passes the sensor.

6. The image recording apparatus according to claim 5, wherein the sensor is an optical sensor having a light-emitting element that emits light and a light-receiving element that receives light from the light-emitting element, wherein moving member is configured to move to a third position where neither the first blocking portion nor the second blocking portion blocks a light path of the optical sensor when a recording medium is removed from the tray, and wherein the control unit determines that no recording medium is held on the tray based on the output signal of the optical sensor transmitted when the moving member is positioned at the third position.

7. The image recording apparatus according to claim 1, wherein the actuator comprises a first rotor disposed at a position corresponding to a storage area for the first recording medium in the tray and a second rotor disposed at a position corresponding to a non-storage area for the first recording medium and a storage area for the second recording medium.

8. The image recording apparatus according to claim 1, wherein the moving member is rotatable.

9. The image recording apparatus according to claim 1, further comprising a guide member disposed above the tray, the guide member being movable between an initial position away from the actuator and a guide position positioned between the actuator and the tray when the tray is fitted to the body, the guide member constituting at least a part of a conveying path for conveying a recording medium when the guide member is disposed at the guide position.

10. The image recording apparatus according to claim 1, wherein the reference position is a position to which the moving member moves when the guide member is moved to the guide position.

11. The image recording apparatus according to claim 1, wherein the tray is configured to be insertable into and removable from the body.

12. The image recording apparatus according to claim 1, wherein the sensor outputs the same signal when the moving member is at the first position and the second position, and outputs a different signal when the moving member is at the third position.

13. The image recording apparatus according to claim 1, wherein the control unit further determines the presence/absence of the first recording medium or the second recording medium based on the change of the ON signal and the OFF signal of the sensor when the moving member is moved between the detection position and the reference position by the reference position moving mechanism.

14. The image recording apparatus according to claim 1, wherein the control unit determines whether the recording medium held on the tray is the first recording medium or the second recording medium based on the change of the ON signal and the OFF signal of the sensor when the moving member is moved to the reference position by the reference position moving mechanism.

15. The image recording apparatus of claim 1, wherein the control unit further determines that neither the first or second recording medium is on the tray when the detected position is detected to be the third position.

16. An image recording apparatus comprising:

a body;

a tray capable of holding a first recording medium having a first size and a second recording medium having a second size;

a moving member movable to a first position, a second position, a third position and a reference position, wherein the moving member positions at the first position when the first recording medium is held on the tray, positions at the second position when the second recording medium is held on the tray, and positions at the third position when neither the first recording medium nor the second recording medium is held on the tray;

an actuator configured to move the moving member to the first position when the first recording medium is held on the tray, move the moving member to the second position when the second recording medium is held on the tray and move the moving member to the third position when neither the first recording medium nor the second recording medium is held on the tray;

a sensor configured to output an ON signal or an OFF signal based on positions of the moving member, the positions including the first position, the second position, the third position and the reference position;

a reference position moving mechanism configured to move the moving member to the reference position; and a control unit that determines a detection position to be detected based on a change of the ON signal and the OFF signal of the sensor when the moving member is moved between the detection position and the reference position by the reference position moving mechanism, wherein the control unit determines that a recording medium held on the tray is the first recording medium when the detection position is detected to be the first position and that a recording medium held on the tray is the second recording medium when the detection position is detected to be the second position wherein the tray comprises a side guide for positioning an end in a width direction of the recording medium held on the tray, and wherein the side guide comprises a first support member that supports the actuator when the tray holding the first recording medium is fitted to the body and a second support member that supports the actuator at a higher position than the first support member when the tray holding the second recording medium is fitted to the body.

17. The image recording apparatus according to claim 16, wherein the first support member is a projection positioned on a side surface of the side guide, and the second support member is the upper end of the side guide.

* * * * *